US011515614B2

(12) United States Patent
Dai

(10) Patent No.: US 11,515,614 B2
(45) Date of Patent: Nov. 29, 2022

(54) HEATABLE VEHICLE GLAZING WITH ANTENNAS

(71) Applicant: Pittsburgh Glass Works, LLC, Pittsburgh, PA (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 40 days.

(21) Appl. No.: 17/232,601

(22) Filed: Apr. 16, 2021

(65) Prior Publication Data

US 2021/0234254 A1 Jul. 29, 2021

Related U.S. Application Data

(63) Continuation-in-part of application No. 17/102,423, filed on Nov. 23, 2020, now abandoned.

(60) Provisional application No. 62/938,988, filed on Nov. 22, 2019.

(51) Int. Cl.

| | |
|---|---|
| ***H01Q 1/12*** | (2006.01) |
| ***H01Q 13/10*** | (2006.01) |
| ***H05B 3/84*** | (2006.01) |

(52) U.S. Cl.

CPC ..... *H01Q 1/1278* (2013.01); *H01Q 13/10* (2013.01); *H05B 3/84* (2013.01)

(58) Field of Classification Search

CPC ..... H05B 6/72; H05B 3/84; H01Q 1/1271; H01Q 1/1278; H01Q 1/32; H01Q 1/325; H01Q 13/10

See application file for complete search history.

(56) References Cited

U.S. PATENT DOCUMENTS

| | | | | |
|---|---|---|---|---|
| 3,655,545 | A | 4/1972 | Gillery et al. | |
| 3,962,488 | A | 6/1976 | Gillery | |
| 4,707,700 | A | 11/1987 | Nagy | |
| 4,768,037 | A | 8/1988 | Hiroshi et al. | |
| 4,849,766 | A | 7/1989 | Hiroshi et al. | |
| 4,864,316 | A | 9/1989 | Murakami et al. | |
| 4,898,789 | A | 2/1990 | Finley | |
| 5,355,144 | A * | 10/1994 | Walton | H01Q 13/16 343/769 |
| 5,670,966 | A | 9/1997 | Dishart et al. | |
| 5,898,407 | A | 4/1999 | Baranski et al. | |
| 6,448,935 | B2 * | 9/2002 | Fuchs | H01Q 1/1278 343/704 |
| 7,764,239 | B2 | 7/2010 | Baranski et al. | |

(Continued)

FOREIGN PATENT DOCUMENTS

DE 102012008033 A1 11/2012

*Primary Examiner* — Jason Crawford

(74) *Attorney, Agent, or Firm* — Dentons Cohen & Grigsby P.C.

(57) ABSTRACT

A slot antenna in a heatable vehicle glazing established between the heating bus bar, bus bar extensions and the peripheral edge of an IR reflective coating. The antenna slot may be fed directly by a voltage source, a current source, or a coupled coplanar line at locations that excite both fundamental and higher order modes for multiband antenna applications. The slot antenna may be established between split bus bars or split bus bar extensions that limit heat loss and improve antenna efficiency. Multiple antennas can be integrated into the heatable glazing for multiband applications and/or diversity antenna systems.

26 Claims, 9 Drawing Sheets

(56) References Cited

U.S. PATENT DOCUMENTS

| | | | | |
|---|---|---|---|---|
| 9,337,525 | B2 | 5/2016 | Dai | |
| 9,406,996 | B2 * | 8/2016 | Lee | H01Q 1/528 |
| 9,647,319 | B2 | 5/2017 | Gedde et al. | |
| 10,347,964 | B2 | 7/2019 | Droste et al. | |
| 10,638,548 | B2 | 4/2020 | Kagaya | |
| 2006/0152421 | A1 * | 7/2006 | Baranski | H01Q 1/1271 343/704 |
| 2012/0256798 | A1 * | 10/2012 | Paulus | H01Q 13/10 343/713 |
| 2015/0222006 | A1 * | 8/2015 | Dai | H01Q 1/1271 343/712 |
| 2017/0040662 | A1 * | 2/2017 | Dai | H01Q 5/371 |
| 2017/0317399 | A1 * | 11/2017 | Droste | H05B 3/84 |
| 2018/0090811 | A1 * | 3/2018 | Kagaya | H01Q 9/30 |
| 2019/0261464 | A1 * | 8/2019 | Noda | H01Q 1/1285 |
| 2019/0273302 | A1 * | 9/2019 | Dai | H01Q 13/10 |
| 2019/0319333 | A1 * | 10/2019 | Dai | H01Q 13/10 |
| 2019/0319334 | A1 * | 10/2019 | Dai | H01Q 1/1271 |
| 2021/0234254 | A1 * | 7/2021 | Dai | H01Q 1/1278 |

* cited by examiner

HEATABLE VEHICLE GLAZING WITH ANTENNAS

TECHNICAL FIELD

The present invention relates generally to a radio frequency ("RF") antenna and, more particularly, an antenna formed in association with an automotive glazing with an electrically heatable coating surface for transmitting or receiving radio signals.

BACKGROUND OF THE INVENTION

Window glazings coated with transparent layers of metal film for control of infrared ("IR") radiation are used in a wide variety of applications such as modern buildings and vehicles. The metallic coatings provide good thermal insulation for buildings and vehicles by reflecting solar energy, thereby limiting heat buildup in the interior while being transparent to light in the visible spectrum. In addition, a transparent, metallic film on the window glazing may be used on vehicle windows to enable a flow of DC current across the window in response to a DC voltage applied to the metallic coating. Such embodiments are typically used to defrost (i.e., melt snow and ice) or defog the window.

Automotive transparencies, such as windshields, side windows and back windows, often incorporate antennas that receive and/or transmit radio frequency waves such as AM, FM, TV, DAB, phone, RKE, etc. These antennas may be formed by silk screened lines such as silver or copper on the transparency or by metal wires or strips that are attached to the transparency. One of the consequences of using metallic coated windows is that they tend to attenuate the propagation of RF signals through the window. As a result, wireless communication into and out of buildings, vehicles, and other structures that use metallic coated windows to reduce heat load may be restricted. One solution for applications in which the metallic coating interferes with the propagation of signals through the window has been to remove a portion of the metallic coating that interferes with the antennas. Removal of the coating facilitates the transmission of RF signals through the portion of the window where the coating is removed. However, removal of the metallic coating may increase solar energy that is transmitted into the interior of the vehicle and thereby increase the vehicle temperature. Also, in glazings where the coating is used to heat the glazing, removal of the metallic coating may bias or interrupt the DC current flow and create a non-heating zone.

Metallic coatings on glazings also have been used to integrate antennas on the metallic coated window. Antennas have been proposed that are based on a theory of operation of quarter wavelength or half wavelength slot antennas that are formed between the metal frame of the window and a conductive transparent film or coating on the transparency. For example, U.S. Pat. Nos. 4,849,766, 4,768,037, 5,670,966 and 4,864,316 illustrate a variety of antenna shapes that are formed by a thin film on a vehicle window. U.S. Pat. Nos. 4,707,700, 5,355,144, 5,898,407, 7,764,239 B2 and 9,337,525 B2 also disclose other slot antenna structures.

Generally, to pass electric current through a transparent conductive coating on a transparency, a voltage source is connected to the conductive coating through a pair of high conductive bus bars that are located on opposite sides of the area of the transparency that is heated. The bus bars have higher conductivity relative to the coating so that current flows more evenly over the area to be heated. European patent DE 10 2012 008 033 A1 to Lotterer and Bernhardt discloses a motor vehicle window that is partially heated by a heating device and that utilizes a non-heated portion of the window as an antenna for transmitting and receiving electromagnetic waves. U.S. Pat. No. 10,347,964 B2 illustrates an electrically heated window with an antenna. The antenna is fed at two locations with a top feed direct connection to the heatable coating and a bottom feed that is capacitively coupled to the heating panel. U.S. Pat. No. 9,647,319 B2 illustrates an electrically heatable window with an antenna element that is connected to one side of the coating and with the antenna capacitively fed by an antenna feeding element. U.S. Pat. No. 10,638,548 B2 to Kagaya also discloses an electrically heated window with an antenna. The antenna includes a transmission line attached to a conductive patch that capacitively coupled to a heating bus extension.

Antennas disclosed in the prior art have used slot antenna concepts. The slot antenna is formed between the metal frame of a window and a side edge of a conductive transparent film layer or coating that is bonded to the window. The slot antenna has been located on the side of the coating where there are no heating bus bars. In those designs, the bus bars are configured substantially in parallel on opposite edge of the transparency. For example, when bus bars are located at the top and bottom of the transparency, the antennas are positioned on the sides of the transparency. For side-to-side heating bus configurations, the antenna has been located on the top and bottom of the transparency. Separate electrical leads are attached to each bus bar on opposite edges of the transparency. At the time that the glazing is installed in the vehicle, this design requires a separate connection for each electrical lead to the positive and negative power source.

Locating the leads on the same side of the transparency and preferably closely adjacent to each other would enable easier installation of the transparency in the vehicle and simplify electrically connecting the transparency to the electrical power source. However, in such designs the bus bars have been essentially conductive strips that are located on all four sides of the transparency so that they overlap the window frame. Bus bars configured in that way would short out an antenna slot located between the metal frame of the window and the side edge of a conductive transparent film layer or coating. This is especially a problem for vehicle windshields where there is very limited area near the edge of the glass that is available for bus bar layout. Thus, traditional slot antennas have not been used in heatable windows.

Furthermore, when the slot that is formed between a window frame and a side edge of conductive transparent film layer or coating on a transparency is used as an antenna, the transparency is bonded to the window frame by an annular sealing member that is in the middle of the slot. The annular sealing member must be a non-conductive material so that it does not load the slot antenna. Therefore, the thickness and position of the annular sealing member and relative position of the coating on the glass and the position between the glass and the window frame affects slot antenna performance. It is difficult to adequately control tight tolerances of such variables during commercial production processes.

Therefore, it would be advantageous to provide an antenna, particularly an electrically heatable IR reflective window hidden antenna, that solves the aforementioned problems. The presently disclosed slot antenna does not primarily use the window frame as one edge of the slot. The antenna meets system performance requirements while monitoring all solar benefits of the heat reflective coating and excellent aesthetics.

SUMMARY OF THE INVENTION

In accordance with the presently disclosed glazing, a slot antenna suitable for use in vehicle applications includes heating capability. The disclosed glazing includes various antenna feed structures and affords improved stability and flexibility with respect to antenna performance and antenna locations. The slot antenna affords improved performance in the VHF and UHF bands while also retaining the benefits of a heat-reflective coating as well as window heating capability for defrosting, deicing, and defogging together with excellent aesthetics.

The slot antenna is formed between a heating bus bar and a conductive, transparent film or coating on a transparency. For the glazing, it is desirable to have the electrical terminals along the same edge of the transparency and located closely adjacent to each other. The bus bars are located along opposite sides of the area of the transparency to be heated. The first bus bar may be close to the terminal location and the second bus bar may be on the opposite side of the glazing away from the terminal location. In the presently disclosed glazing, the second bus bar is connected to the electrical circuit by extending highly conductive members from opposite ends of the second bus bar along opposite ends of the transparency. The extended conductive members are isolated from the conductive coating on the transparency by laser deletion lines near the conductive members. When a DC voltage is applied to the electrical terminals, electric current flows through the conductive coating on the surface of the transparency to heat the glazing. When no electrical current moves through the coating, the coating continues to function as a solar control coating that limits the passage of IR radiation through the glazing. The conductive members overlap the window frame and, at operating frequencies of the antenna, are electrically connected to the vehicle body through capacitive coupling. A slot antenna is created by deleting the conductive coating in a marginal area adjacent the conductive members. The slot dimension is designed to support fundamental and higher order modes within the frequency bands of interest. Preferably, the total slot length equates to one-half wavelength for fundamental mode and one wavelength for the first higher excitation mode.

The slot antenna can be excited by a voltage source such as a balanced parallel transmission line that is connected to the opposite edges of the slot or by a coaxial transmission line that is electrically connected to the opposite edges of the slot. The slot antenna may also be fed by a coplanar line probe. There the inner conductor is extended along the center of the slot to form a coplanar transmission line, effectively giving a capacitive voltage feed. The slot antenna may also be excited by a current source such as a looped coaxial cable end that excites the slot antenna through magnetic coupling. Energy applied to the slot antenna causes electrical current flow in the conductive coating and conductive members of the glazing. The electrical currents are not confined to the edges of the slot, but spread over the conductive film and conductive members. Radiation then occurs from the edges and sides of the conductive sheets and conductive members.

Traditionally, slot antennas have employed a slot located between a window frame and a side edge of a conductive transparent film layer or coating on a transparency. The transparency is bonded to the window frame by an annular sealing member that is in the middle of the slot. However, the annular sealing member is a dielectric material that may load the slot antenna. Therefore, the thickness and position of the annular sealing member and relative position of the coating on the glass and the position between glass and window frame all affect slot antenna performance. Tolerances as to all of those variables are difficult to control in mass production. Furthermore, to make traditional slot antennas work, a high-cost non-conductive adhesive must be used to bond the transparency to the window frame. The presently disclosed glazing shifts location of the slot antenna away from the annular sealing member and closer to the portion of the glazing between the conductive members and the edge of the electrically-conductive coating. This affords improved tolerance control in mass production with additional cost saving benefits for customers by using less-costly adhesives for window bonding.

In accordance with the disclosed invention, an electrically heatable glazing that is receivable in a frame cooperates with the frame to define an antenna. The glazing includes a transparency sheet that has a major surface that is defined inside a perimeter edge. An electrically-conductive coating is located on the major surface of the transparency sheet. A first bus bar has greater electrical conductivity than the electrical conductivity of the electrically-conductive coating. The first bus bar contacts the electrically-conductive coating adjacent a first portion of the perimeter edge of the transparency sheet. A second bus bar that also has electrical conductivity that is greater than the electrical conductivity of the coating contacts the electrically-conductive coating adjacent a second portion of the perimeter edge of said transparency sheet. The second portion of the perimeter edge of the transparency sheet is located oppositely on said transparency sheet from the first portion of the perimeter edge of the transparency sheet. Also, the glazing includes a first electrically-conductive member that is electrically isolated from direct current in the second bus bar and from direct current in the electrically-conductive coating. The first electrically-conductive member has a first portion that is located between the first bus bar and the second portion of the perimeter edge of the transparency sheet. The first electrically-conductive member also has a second portion that is located adjacent the second portion of the perimeter edge of the transparency sheet. A second electrically-conductive member is electrically isolated from direct current in the second bus bar and from direct current in the electrically-conductive coating. The second electrically-conductive member has a first portion that is located between the first bus bar and the second portion of the perimeter edge of the transparency sheet. The second electrically-conductive member also has a second portion that is located adjacent the second portion of the perimeter edge of the transparency sheet. An antenna slot in the glazing has oppositely disposed sides with one side of the antenna slot defined by the first or second electrically-conductive members. A second side of the antenna slot is oppositely disposed from the one side of the slot and is defined by a portion of the perimeter edge of the electrically-conductive coating. The antenna slot has a length and width such that the antenna slot cooperates with one of the first or second electrically-conductive members, with the frame, and with the electrically-conductive coating to define a slot antenna. Electrical leads are connected to the first and second bus bars and extend from the second portion of the perimeter edge of the transparency sheet. The glazing also includes an antenna feed connector that is electrically connected to the slot antenna.

Preferably, the first and second bus bars and the first and second electrically-conductive members are bonded to the transparency sheet of the glazing at locations adjacent the periphery of the transparency sheet. The first and second bus bars and the first and second electrically-conductive members overlap the frame such that the slot antenna is capacitively coupled to the frame at RF frequencies. The electrically-conductive coating, the first and second bus bars, and the first and second electrically-conductive members cooperate with the frame to define a ground plane at RF frequencies.

Also preferably, a first slot line in the electrically-conductive coating isolates the first and second electrically-conductive members from direct current flowing in the electrically-conductive coating and from direct current flowing in the second bus bar. The first slot line may have a width in the range of 0.05 mm to 0.2 mm, preferably in the range of 0.08 mm to 0.1 mm. The electrically-conductive coating is electrically connected at RF frequencies to the first and second electrically-conductive members through capacitive coupling across the first slot line in the electrically-conductive coating.

In some embodiments, a portion of the electrically-conductive coating is removed or absent adjacent a first edge of at least one of the first and second electrically-conductive members to define a slot antenna. At least one of the first and second electrically-conductive members has a first edge that faces the electrically-conductive coating such that a portion of the first edge of at least one of the first and second electrically-conductive members defines one side of the slot antenna and a portion of the outer or perimeter edge of the electrically-conductive coating defines the opposite side of the slot antenna.

In certain embodiments, the slot antenna is fed by a coaxial cable with the outer conductor of the coaxial cable electrically connected to the frame and also electrically connected to the first or second electrically-conductive member through capacitive coupling. The center conductor of the coaxial cable is connected to at least one antenna feed pad on the perimeter or outer edge of the electrically-conductive coating.

In some embodiments, the slot antenna of the glazing is fed by a coaxial cable with the outer conductor of the coaxial cable electrically connected to the frame and also electrically connected to the first or second electrically-conductive member through capacitive coupling. The center conductor of the coaxial cable is connected to a first antenna feed pad that is on the perimeter edge of the electrically-conductive coating and that is also connected to a second antenna feed pad that also is on the perimeter edge of said electrically-conductive coating.

In accordance with the presently disclosed invention, a second slot line electrically isolates the first antenna feed pad or the second antenna feed pad from direct current in the electrically-conductive coating. The first antenna feed pad or the second antenna feed pad are electrically connected to the electrically-conductive coating at RF frequencies through capacitive coupling.

Embodiments of the disclosed glazing may include a second slot line in the electrically-conductive coating that defines a first end at a location where the second slot intersects the portion of the outer edge of the electrically-conductive coating that defines the opposite side of the antenna slot. The second slot line further defines a second end at a second location where the second slot line intersects the portion of the outer edge of the electrically-conductive coating that defines the opposite side of the antenna slot. Either the first antenna feed pad or the second antenna feed pad is located on the portion of the perimeter edge of the electrically-conductive coating that defines the opposite side of the antenna slot and also between the first end and the second end of the second slot line. In this way the second slot line mitigates cold spots on the electrically-conductive coating between the first antenna feed pad and the second antenna feed pad and also mitigates hot spots on the electrically-conductive coating adjacent the first antenna feed pad and adjacent the second antenna feed pad.

In some embodiments, the first antenna feed pad and the second antenna feed pad are located on the outer edge of the electrically-conductive coating that defines the opposite side of the antenna slot. The glazing further includes a second slot line in the electrically-conductive coating. The second slot line defines a first end at a location where the second slot line intersects the portion of the perimeter edge of the electrically-conductive coating that defines the opposite side of the antenna slot. The first end is also located outside the portion of the perimeter edge of the electrically-conductive coating that is located between the first antenna feed pad and the second antenna feed pad. The second slot line further defines a second end that terminates in the electrically conductive coating at a location that is equidistant from the first antenna feed pad and the second antenna feed pad such that the second slot defines an "L-shaped" pattern between the first end and the second end of the second slot line. The "L-shaped" second slot line biases direct current flowing in said electrically-conductive coating around the second slot line such that the voltage potential at the first antenna feed pad tends to be equivalent to the voltage potential at the second antenna feed pad.

In some embodiments of the glazing, the slot antenna is fed by a coupled coplanar line that is laterally spaced midway between the edge of the first electrically conductive member and the perimeter edge of the electrically-conductive coating that defines the opposite side of the antenna slot. The coupled coplanar line also may be laterally spaced midway between the edge of the second electrically-conductive member and the perimeter edge of the electrically-conductive coating that defines the opposite side of the antenna slot.

In embodiments of the disclosed glazing, the outer conductor of the coaxial cable is connected to the first electrically-conductive member or to the second electrically-conductive member. The center conductor of the coaxial cable is extended and coiled in the antenna slot and connected back to the first or second electrically-conductive member to form loops in the center conductor that excite the slot antenna by magnetic coupling.

In some embodiments of the disclosed glazing, it may be preferred that the antenna feed connector further includes a first conductive trace portion that is located inside the glazing laminate. One end of the first conductive trace portion is connected to at least one of the first antenna feed pad of the second antenna feed pad. A second conductive trace portion of the antenna feed connector is located at least partially outside the glazing laminate. The second conductive trace portion has a cross-section that has a greater area than the area of the cross-section of the first conductive trace portion. The first conductive trace portion may reduce capacitive coupling between the antenna feed connector and the first and second electrically-conductive members to improve impedance matching of the slot antenna. The second conductive trace portion increases capacitive coupling between the antenna feed connector and the frame to improve impedance matching of the slot antenna.

Some embodiments of the disclosed glazing may have at least one of the first electrically-conductive member and the second electrically-conductive member that define two branches with a split between the two branches. In this glazing, the two branches cooperate to form a slot antenna between the two branches. The branches of the first electrically-conductive member or the branches of the second electrically-conductive member have higher electrical conductivity than the conductivity of the electrically-conductive coating. The electrical current of the slot antenna may concentrate in the two branches. The branches may improve the efficiency of the slot antenna by reducing resistive losses that are due to electrical current. In some embodiments, at least one of the first bus bar or the second bus bar may be split into two sub-buses such that the sub-buses define a split sub-bus slot antenna between the two sub-buses. In some embodiments of the disclosed glazing, multiple split sub-buses are located at respective multiple positions in the glazing to form respective multiple slot antennas. Preferably, the split sub-buses are located at least $\lambda/4$ wavelength apart for wavelengths at operational frequencies of the glazing to provide an antenna diversity system.

In some examples of the disclosed glazing, slot antennas on split bus bars are used for UHF antennas that include DAB and TV frequencies. The antenna slot may be apart from the perimeter edge of the transparency sheet such that adhesives that bind the transparency sheet to the frame do not affect the performance of the slot antenna. Preferred embodiments of the disclosed glazing may have a slot antenna that enables control of tolerances during commercial production.

The advantages of the invention are particularly significant for automotive windows where space for concealing heating bus bars and antenna structures is very limited. Such an application would be typically in heated automotive windshields, although the invention is not so limited.

BRIEF DESCRIPTION OF THE DRAWINGS

For a more complete understanding of the disclosed invention, reference should now be had to the embodiments illustrated in greater detail in the accompanying drawings and described below by way of examples of the invention. In the drawings.

DETAILED DESCRIPTION OF THE INVENTION

Figure 1:
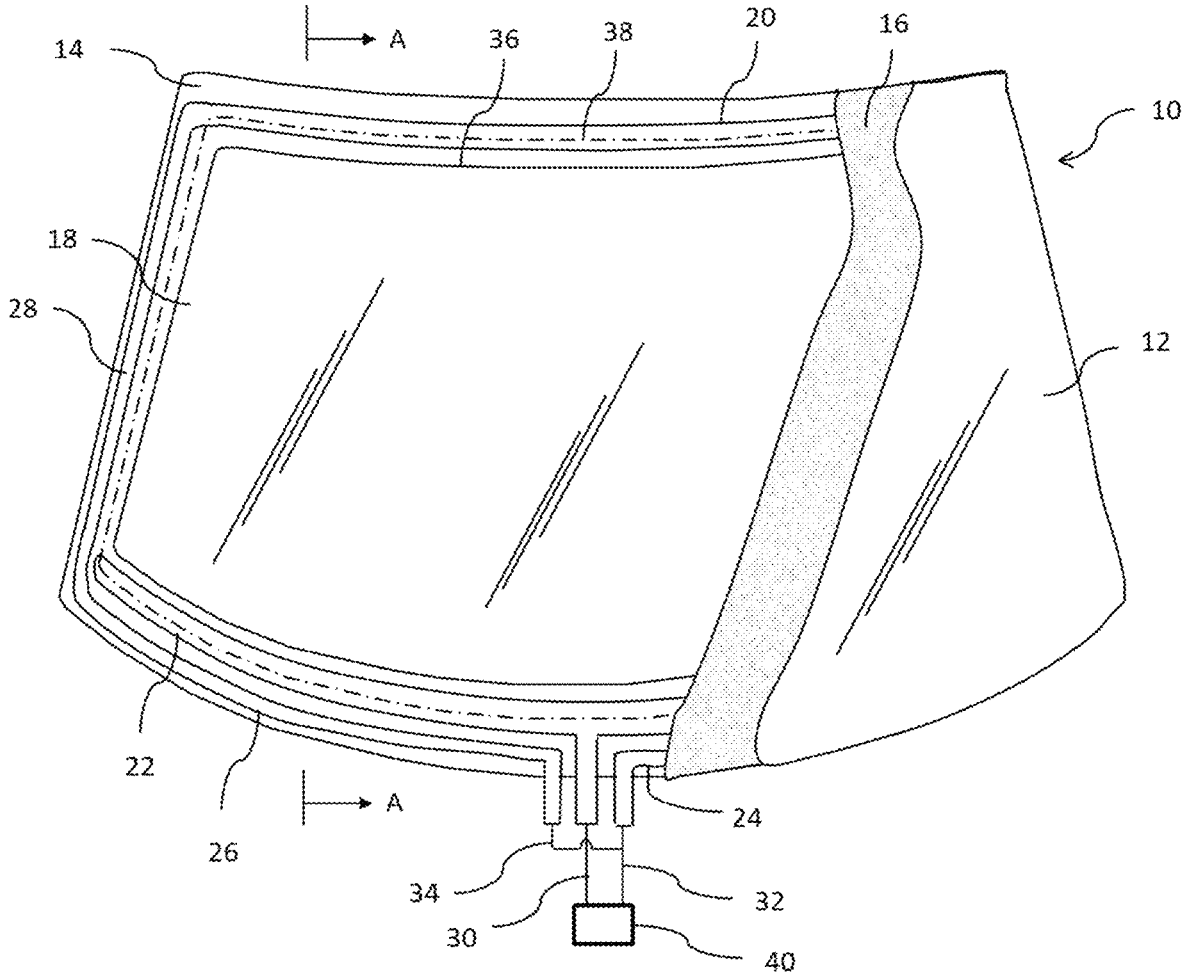
FIG. 1 is a plan view of an automotive windshield incorporating features of the presently disclosed invention.

FIG. 1 shows a plan view of a transparent windshield 10 incorporating features of the presently disclosed invention. Window 10 is a laminated vehicle windshield formed of outer and inner glass plies 14 and 12 that are bonded together by an interposed layer 16, preferably of a polyvinyl butyral, polyvinyl chloride, polyurethane or similar material. Outer glass ply 14 defines an outer surface (conventionally referred to as the number 1 surface) on the outside of the vehicle and an inner surface (conventionally referred to as the number 2 surface). Inner glass ply 12 defines an outer surface (conventionally referred to as the number 3 surface) on the inside of the glazing and a surface (conventionally referred to as the number 4 surface) that faces toward the interior of the vehicle and is the internal side of window 10. Interlayer 16 is located between surface number 2 and surface number 3.

Figure 2:
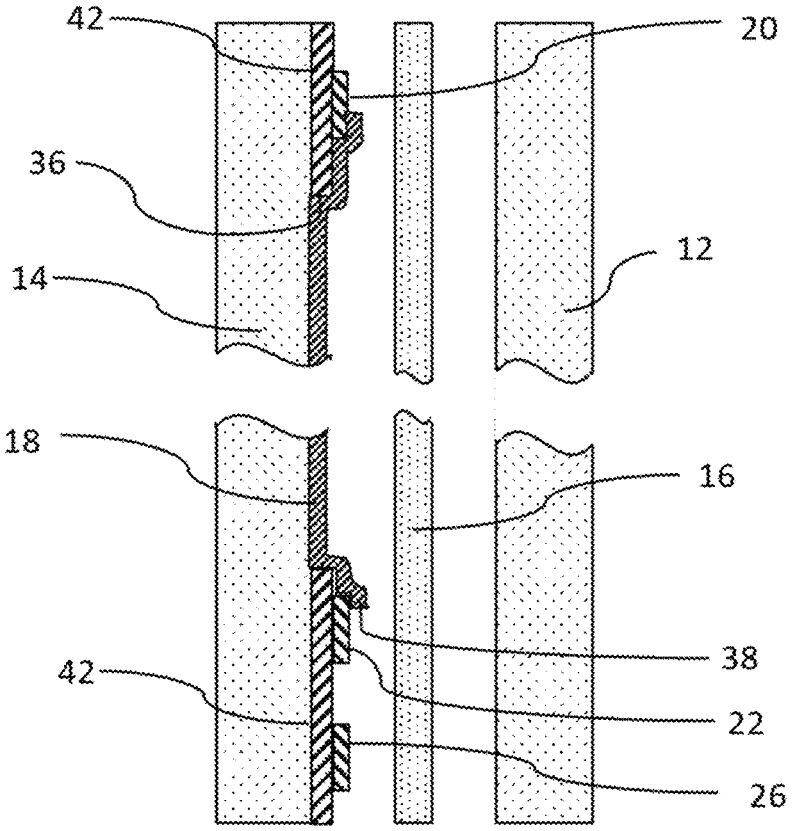
FIG. 2 is a partially exploded sectional view taken along line A-A in FIG. 1.

As shown in FIG. 2, the window glass 10 may include an obscuration band 42 formed by screen printing opaque ink onto the glazing and subsequent firing around the perimeter of the window glass. Obscuration band 42 has a closed inner edge 36 that defines the boundary of the daylight opening (DLO) of glazing 10. The obscuration band 42 is sufficiently wide to conceal the bus bars, heating circuits, antenna elements and other apparatus around the glass edges that are hereinafter shown and described.

Windshield 10 further includes an electro-conductive coating or element 18 that occupies the daylight opening of the transparency. The conductive coating serves as a solar shield that reduces transmission of infrared and ultraviolet radiation through the glazing. Electro-conductive element 18 is preferably a transparent electro-conductive coating applied on No. 2 surface of the outer glass ply 14 (as shown in FIG. 1) or on No. 3 surface of the inner glass ply 12, in any manner known in the art. The coating may be single or multiple layers of a metal-containing coating as, for example, disclosed in U.S. Pat. No. 3,655,545 to Gillery et al.; U.S. Pat. No. 3,962,488 to Gillery and U.S. Pat. No. 4,898,789 to Finley. The conductive coatings have a sheet resistance of about 2.7Ω/□ for an optical transmission of about 75%.

In a preferred embodiment illustrated in FIGS. 1 and 2, windshield 10 further includes a top bus bar 20 and bottom bus bar 22 each being mounted on coating layer 18 and overlapped and electrically connected to coating layer 18. Coating layer 18 has a coating edge 38 that is spaced from the outer side edges and from the top and bottom outer edges of windshield 10. The uncoated area between coating edge 38 and the outer edges of windshield 10 may be created by masking the area during the coating process. Alternatively, the entire surface of outer ply 14 may be coated and the coating subsequently deleted from the area between coating edge 38 and the outer side edges and the top and bottom outer edges of ply 14.

As shown in FIG. 1, the connection to top bus bar 20 include two conductive strips 26 and 24, respectively, extending in opposite directions along the bottom edge of the windshield 10 from terminal area and conductive side strips 28 (shown only one side in FIG. 1), extending along opposite side portions of the windshield 10. Conductive side strips 28 connect strip 26 and 24 to respective, opposite ends of upper bus bar 20. Bus bars 20 and 22 and conductive strips 24, 26 and 28 are preferably made of silver-containing ceramic material of a type known in the art. They may be silk screened onto the glass surface and thereafter fused by heating. The conductivity of bus bars 20 and 22 and conductive strips 24, 26 and 28 is selected such that the electrical conductivity is substantially greater than the electrical conductivity of coating 18 to reduce energy loss due to heating in the bus bars and in the conductive strips. Electrical connection between a power source 40 and windshield 10 is preferably made at a location along the lower edge at the terminal area. However, the connections may also be adjacent any edge of windshield 10 and any location along the edge. Locating the leads on the same side of the transparency and preferably closely adjacent to each other enables easier installation of the transparency in the vehicle and simplifies the connection between windshield 10 and electrical power source 40. Electrical lead 30 connects bottom bus bar 22 to one pole of electrical source 40. Strips 26 and 24 leading to top bus bar 20 may be wired in common to the opposite pole of electrical power source 40 by a jumper wire 34 and a lead 32. In this way, electrical current is flows across metal layer 18 between bus bars 22 and 20 to heat the windshield.

In the prior art, vehicle glazings with a metallic coating that limits infrared radiation through the glazing define a spacing at the perimeter of the metallic coating to create a slot antenna in the glazing. The slot is formed between the metal frame for the window and the conductive transparent film or coating that is bonded to the window. One or more outer peripheral side edges of the transparent film are spaced from the inner edge of the window frame to define the slot antenna. The total slot length is one wavelength for an annular shaped slot or one half-wavelength for non-annular shaped slot for the fundamental excitation mode.

Figure 3:
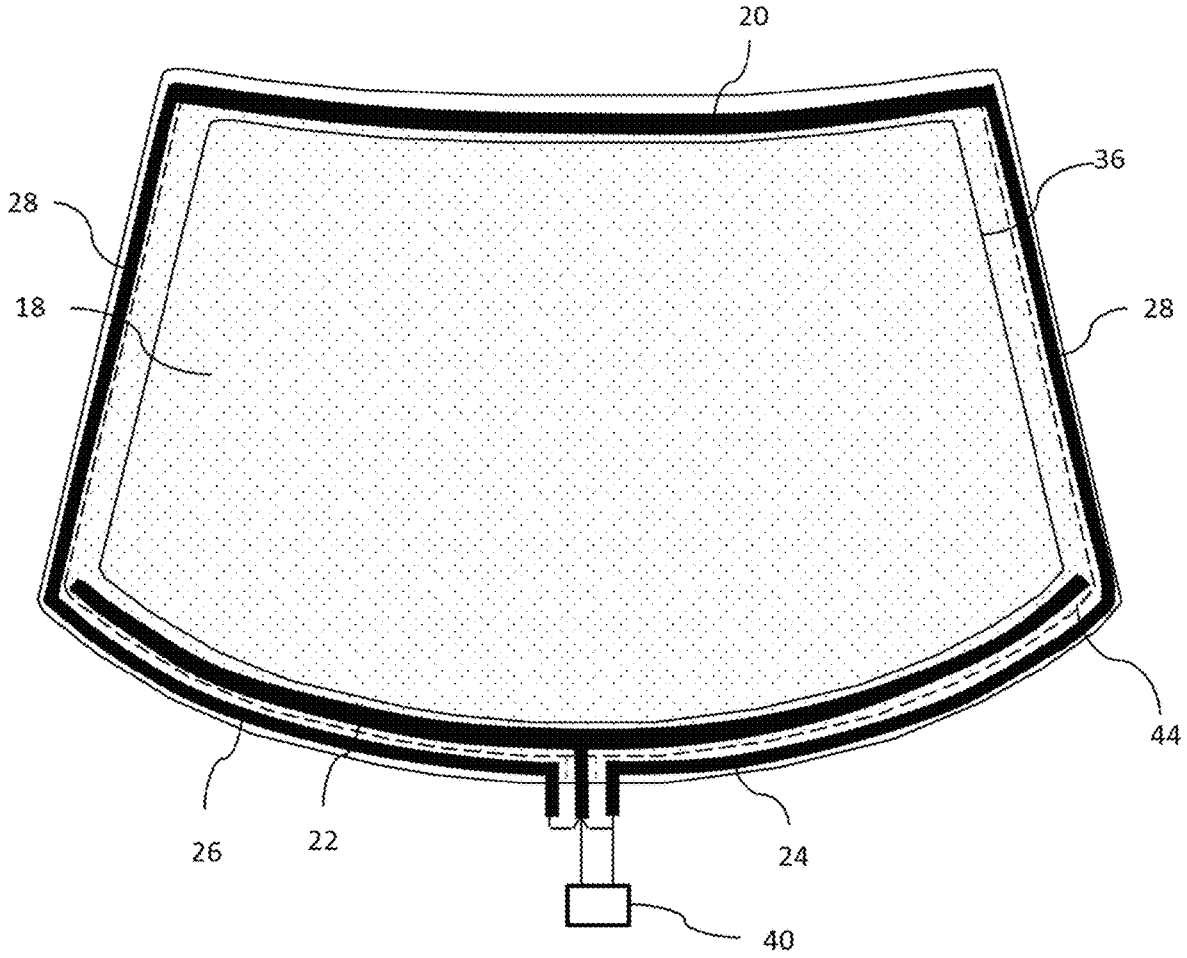
FIG. 3 is a plan view of a windshield with the outer glass removed and incorporating a preferred embodiment of the bus bar arrangement of the present invention.

Referring to FIG. 3, top bus bar 20 covers a slot at the top of the glazing and bottom bus bar 22 and conductive strips 24 and 26 cover a slot at the bottom of the glazing. In addition, conductive strips 28 cover respective slots at the two sides of the glazing. Top bus bar 20, bottom bus bar 22, and conductive strips 24, 26 and 28 all overlap the window frame and are capacitively coupled and connect the coating layer 18 to the window frame at RF frequencies. Therefore, the heating bus bar 22, 20 combined with conductive strips 24, 26 and 28 short out the antenna slot to the window frame.

Figure 4:
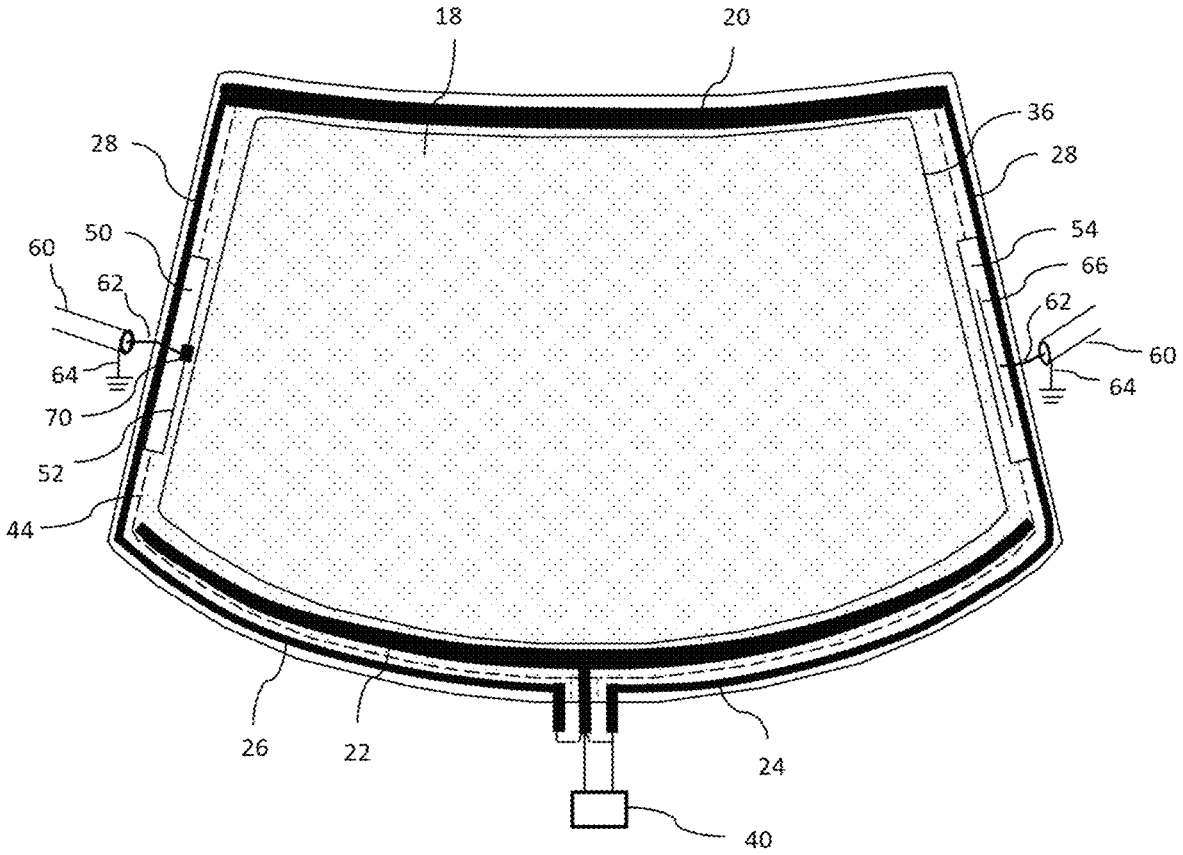
FIG. 4 is a schematic of an embodiment of a glazing incorporating features of the presently disclosed glazing in which a slot antenna is formed at each side of the windshield.

Now referring to FIG. 4, coating layer 18 covers the entire inner surface of outer ply 14 except a band of coating 18 is removed from the inner surface of outer ply 14 between inner edge of conductive strip 28 and a deletion edge 52 of coating 18 to form a band 50. Coating 18 may be removed from glazing 10 either by mask deletion or laser deletion techniques. Deletion edge 52 is laterally located on glazing 10 between the inner edge 36 of obscuration band 42 and inner edge of strip 28. Band 54 is formed on the opposite side of glazing 10 from band 50 in the same fashion. Strips 28, 26 and 24 are isolated from coating 18 and bottom bus bar 22 by a laser deletion line 44. Line 44 is a thin slot created by a laser beam to provide DC isolation between conductive strips 28, 24, and 26 and coating 18 and bottom bus bar 22. Laser line 44 has a width in the range of 0.05 mm to 0.2 mm, preferably in the range of 0.08 mm to 0.1 mm. The thin slot in laser line 44 provides DC electrical isolation, but at RF frequencies coating 18 is electrically connected to strips 28, 26 and 24 through capacitive coupling across the thin slot. Removal of coating 18 in this way provides the basic structure of an antenna slot on coating 18.

Traditional slot antennas use a slot that is formed between the window frame and the side edge of a conductive, transparent film layer or coating. The film layer or coating is on a transparency with the side edge of the film layer being located near the periphery edge of the transparency. In vehicles, the transparency is bonded to the window frame by an annular seal member that is located substantially in the middle of the antenna slot. The annular seal member must not be electrically conductive or its dielectric property will load the slot antenna. Therefore, the thickness and position of the annular sealing member as well as the relative position of the coating on the transparency, and the separation between the transparency and the metal frame all affect slot antenna performance. During commercial production, the tolerances of those respective elements and the position variables among them are difficult to control to a degree necessary to produce satisfactorily consistent antenna performance. Furthermore, to make the traditional slot antenna work, a relatively expensive, non-conductive adhesive is required to bond the transparency to the window frame. The presently disclosed embodiment relocates the slot antenna to a location on the transparency between conductive strip 28 and side edge 52 of coating 18 as shown in FIG. 4. This supports better control over tolerances and positioning during commercial production. Additionally, cost savings also become available through the use of less-costly conductive adhesive for window bonding.

Windshield 10 and its associated heating elements define an antenna slot 50 between a portion of the inner edge of conductive strip 28 on one side and coating edge 52 of coating 18 on the opposite side. The slot width of slot 50 must be sufficiently large that the capacitive effects across it at the frequency of operation are negligible so that the signal is not shorted out. The slot width is preferably greater than 10 mm. The preferred length of the slot is an integer multiple of one half of the wavelength with respect to the resonant frequency of application. For a windshield of a typical vehicle, the slot length may be designed to resonate at the VHF and UHF bands which can be used for FM, DAB, TV and FM applications.

The slot antenna can be excited by a voltage source such as a balanced parallel transmission line that is connected to the opposite edges of the slot or by an unbalanced transmission line, such as a coaxial transmission line that is connected to the opposite edges of the slot. FIG. 4 shows that antenna slot 50 is fed by a coaxial cable 60. The ground conductor of the coaxial cable 60 is connected to the vehicle chassis by a wire 64 and connected to conductive strip 28 through capacitive coupling, near one edge of the slot 50. The ungrounded conductor, such as the central conductor of coaxial cable 60 is connected to the coating 18 near the opposite edge of slot 50 by an antenna connector 62 and an antenna feed pad 70. Antenna connector 62 is isolated from conductor strip 28 and the window frame by insulating layer on top and bottom of antenna connector 62. Antenna connector 62 and the central conductor of coaxial cable 60 is also DC isolated from coating 18, preferably by a series capacitor at the amplifier input. In this way the antenna feeding network is DC isolated from conductive strip 28 and coating 18 such that the heating function does not disturb the slot antenna feeding network.

Figure 5:
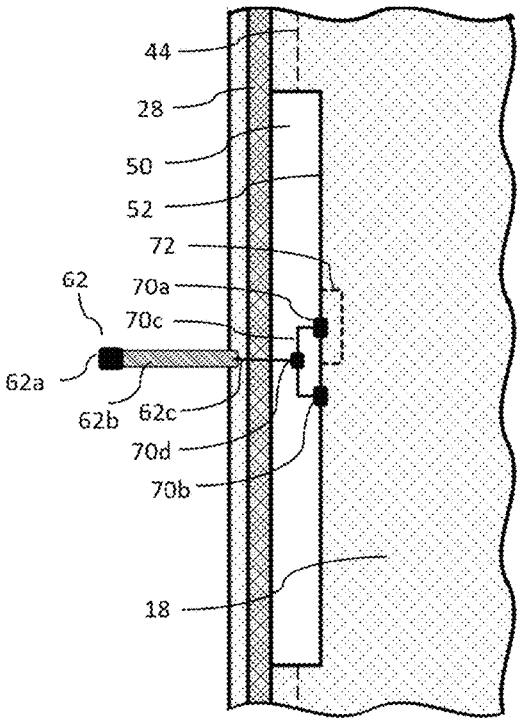
FIG. 5 is a diagram of another embodiment of a glazing incorporating features of the presently disclosed glazing in which a slot antenna is fed at two locations with a first slot for DC isolation and a second slot that controls temperature extremes in an electrically-conductive coating.
Figure 6:
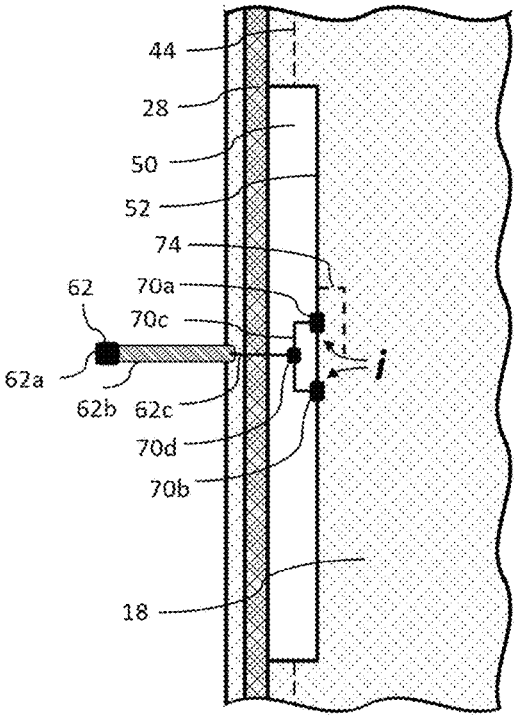
FIG. 6 is a diagram of another embodiment of a glazing incorporating features of the presently disclosed glazing in which a slot antenna is fed at two locations with an L-shaped slot for DC isolation.

FIG. 5 and FIG. 6. illustrate an alternative embodiment for feeding slot 50 where there are two antenna feed pads 70*a* and 70*b* on the coating edge 52. A conductive line 70*c* connects antenna feed pads 70*a* and 70*b*. An antenna connector pad 70*d* is situated in the middle of conductive line 70*c* and is connected to one end of antenna connector 62. Since antenna feed pads 70*a* and 70*b* on coating 18 are connected by high conducive line 70*c*, when coating 18 is used for heating, DC current flows on line 70*c* to bypass coating 18 between antenna feed pads 70*a* and 70*b*. The current bypass causes cold spots on coating 18 between antenna feed pads 70*a* and 70*b* and hot spots near antenna feed pads 70*a* and 70*b*. As shown in FIG. 5, a slot line 72 provides DC isolation between antenna feed pad 70*a* and coating 18. The width of the slot is small; preferably, in the range of 0.1 mm such that antenna feed pad 70*a* is connected to coating 18 through capacitive coupling at the antenna operating frequencies. FIG. 6 shows an alternative embodiment wherein an inverted "L" shape slot 74 extends partially around antenna pad 70*a*. Slot 74 causes DC current to detour around slot 74 edges such that same voltage potential is achieved on antenna feed pads 70*a* and 70*d* with minimal or no DC current flow on conductive line 70*c*.

Antenna connector 62 connects slot antenna 50 to an electronic device. Antenna connector 62 as shown in FIG. 5 and FIG. 6 may provide better impedance matching for the slot antenna. Antenna connector 62 comprises: (1) a flexible insulating substrate; (2) a transmission line that is printed on the insulating substrate to carry signals from the antenna to the electronic device; and (3) an insulating cover tape to isolate the transmission line from ground. The transmission line further comprises: (1) a solder pad that is located inside the glass laminate and that is galvanically connected to antenna connector pad 70*d*; (2) a thin conductive trace portion 62*c* that is also located inside the glass laminate and that overlaps heating bus side strip 28, (3) a wide conductive trace portion 62*b* that is located outside the glass laminate and that is capacitively coupled to the vehicle ground frame; and (4) a terminal portion 62*a* that is connected to the electronics device that is mounted on the vehicle metal frame. Thin conductive trace 62*c* reduces capacitive coupling between antenna connector 62 and conductive strip 28. Wide conductive trace portion 62*b* increases capacitive coupling between antenna connector 62 and the window frame. In this way, the antenna connector affords improved antenna impedance matching to the electronic device.

FIG. 4 shows that the slot antenna can also be fed by a coupled coplanar line. Antenna slot 54 has a coplanar line 66 that is situated half-way between inner edge of conductive strip 28 and side edge of coating 18 and is in parallel with conductive strip 28. Coplanar line 66 does not connect to the conductive strip 28 or coating 18 and effectively gives a capacitive voltage feed. As such, it is a distributed feed and coplanar line 66 may cross voltage points of both fundamental and higher order modes of slot 54. Excitation of higher order modes is desirable to accommodate high frequency and multiband antenna applications such as TV antennas and antennas with more than one frequency band.

Figure 7:
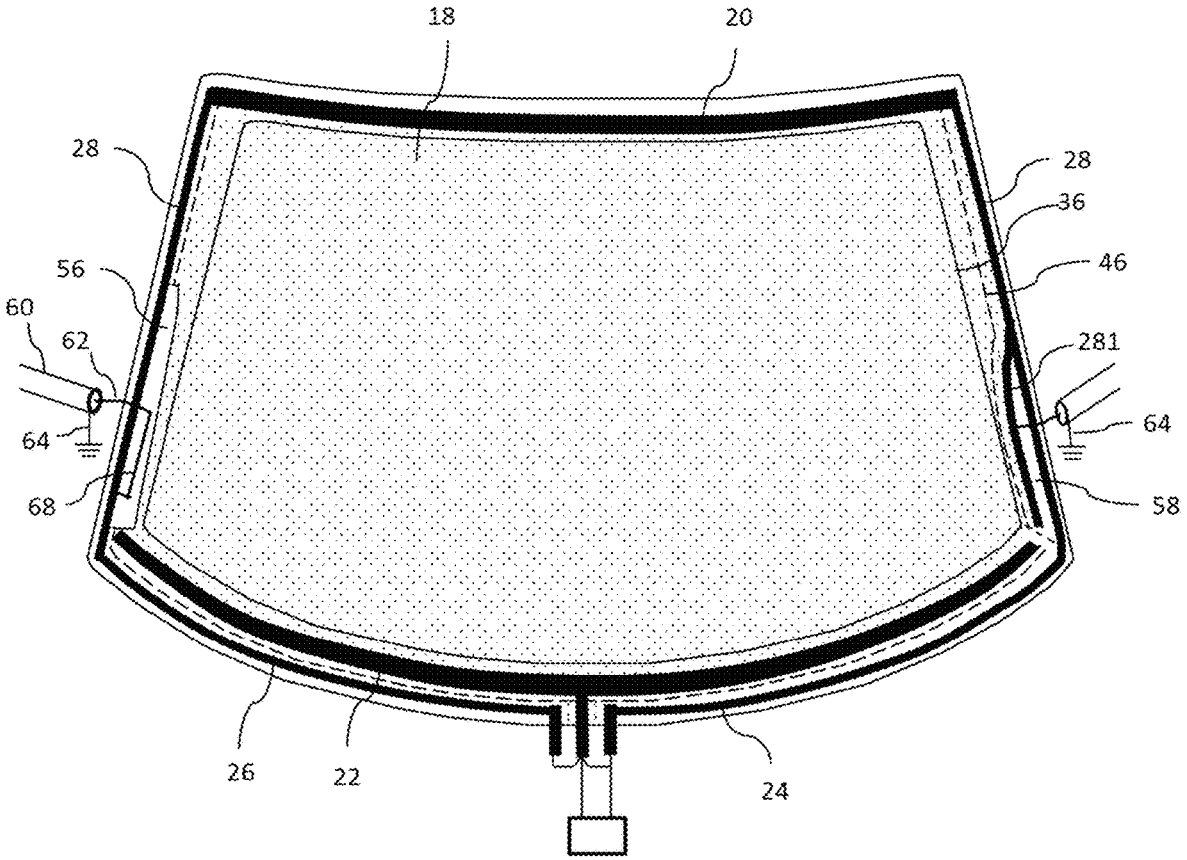
FIG. 7 is a diagram of another embodiment of a glazing incorporating features of the presently disclosed glazing in which a slot antenna is formed at each side of the glazing.

The slot antenna can further be excited by a current source as shown in antenna slot 56 in FIG. 7. FIG. 7 shows that antenna connector 62 of coaxial cable 60 is connected to a wire 68 that is wound or coiled in a slot 56 and connected back to conductive strip 28. Ground wire 64 of coaxial cable 60 is also electrically connected to conductive strip 28 through capacitive coupling. Wires 62, 68 (wound or coiled) and 64 effectively form loops that excite slot antenna 56 by magnetic coupling. Coaxial cable 60 is DC isolated from conductive strip 28 by series capacitors between coaxial cable and conductive strip 28 such as in wires 62 and 64.

Antenna slots 50, 54 and 56 are formed between inner edge of conductive strip 28 on one side and the side edge of coating 18 on the other side. The edges and surfaces of coating 18 have relatively low conductivity such that current flow on the coating edges and surfaces results in resistive losses that compromise antenna performance. In a slot antenna, the electrical current concentrates near the antenna feed point and the edges of the slot. This can result in significant resistance losses on the surfaces and edges of conductive coating 18. To increase antenna efficiency, FIG. 7 illustrates a high conductive strip 281 (such as silver or copper) that is printed on the high current density area that is along the edge of slot antenna 58 and in contact with coating 18. High conductive strip 281 causes the slot antenna to be defined by edge strip 28 and the edge of strip 281. Most of the RF current flows and concentrates on the high-conductive material of strips 28 and 281 providing low loss. The increased conductivity of the current path increases antenna radiation efficiency. Strips 28 and 281 also provide more uniform current distribution and avoid high current density to further reduce signal resistance loss. Preferably, strips 28 and 281 covers the entire length of the edges of slot 58 for best performance. However, the most significant portion of the current path is about half to one wavelength from the antenna feed point where the current density is the highest. Conductive strips 28, 281, 26 and 24 are isolated from coating 18 and bottom bus bar 22 by a laser deletion line 46.

Figure 8:
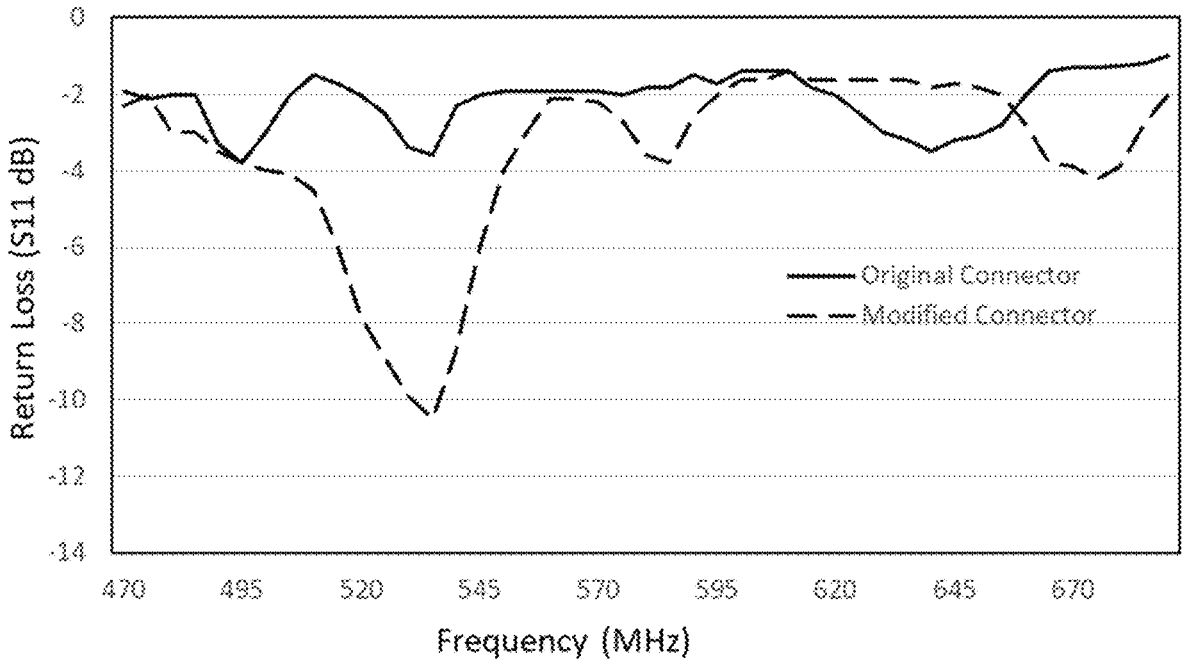
FIG. 8 is a simulated plot of antenna return loss for one embodiment of a glazing on a vehicle illustrating return loss over resonant frequency bands from 470 MHz to 690 MHz.

An embodiment similar to that illustrated in FIGS. 4 and 5 with a voltage probe feed was simulated and tested on a vehicle. FIG. 8 shows the simulated plot of the return loss (S11) of the slot antenna on a vehicle with two different antenna connectors. The simulated S11 in solid line showing return loss for an antenna feed with a connector of a uniform transmission line of 7 mm in width. The simulated S11 in dashed line shows return loss for an antenna feed with a modified connector of a transmission line. The modified connector includes a thin (1 mm in width) conductive trace portion that is inside the laminated glass and a wide (7 mm in width) portion that is outside the laminated glass. The simulated antenna return loss of the modified antenna connector shows improved antenna matching in the TV frequency band from 470 MHz to 690 MHz.

Figure 9:
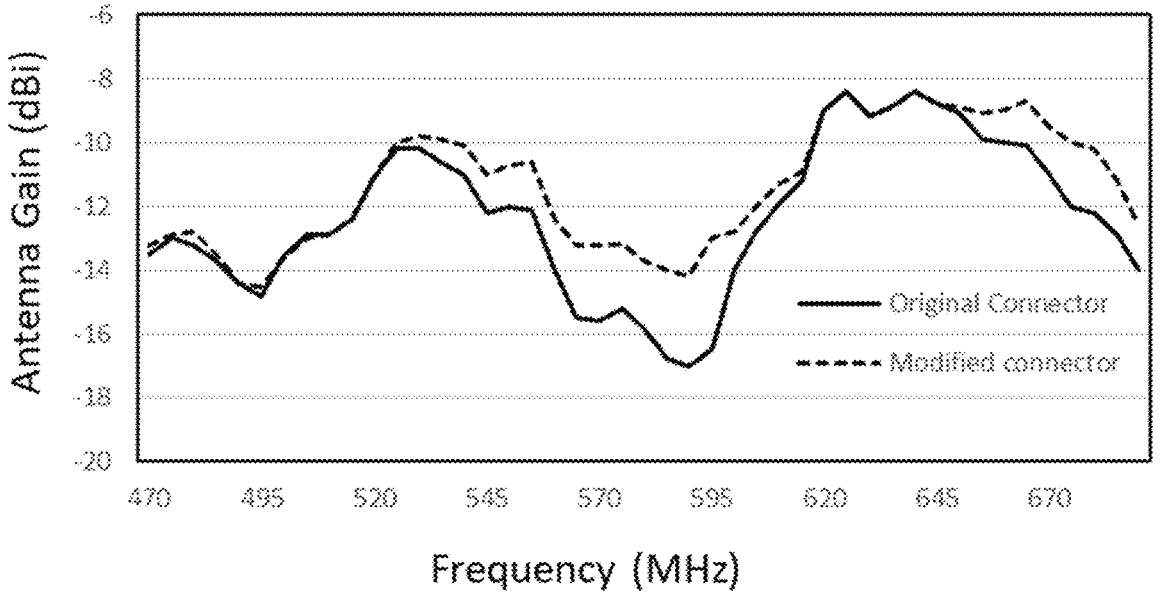
FIG. 9 is a measurement gain plot of an antenna glazing on a vehicle illustrating the antenna average gain from 470 MHz to 690 MHz at vertical polarization for two different antenna connectors.
Figure 10:
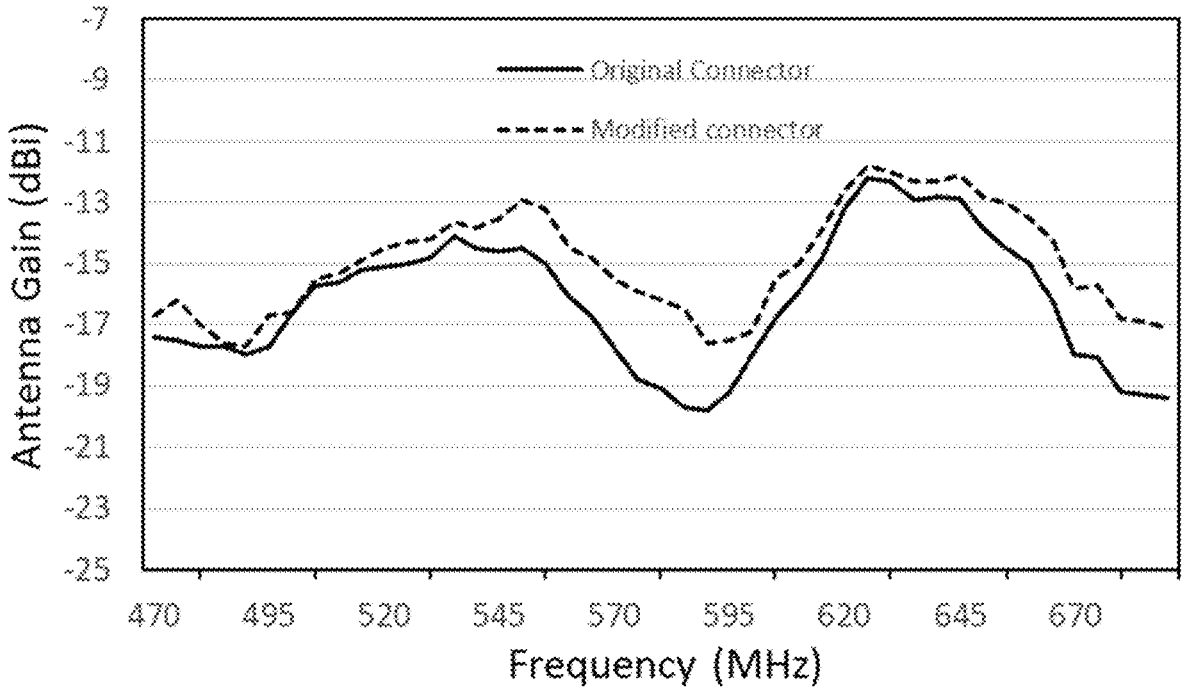
FIG. 10 is a measurement gain plot for an antenna glazing on a vehicle illustrating the antenna average gain from 470 MHz to 690 MHz at horizontal polarization for two different antenna connectors.

FIGS. 9 and 10 illustrate average antenna gain of the window assembly on a vehicle according to the same connector described in connection with FIG. 8. FIG. 9 illustrates antenna performance at vertical polarization over a TV frequency band from 470 MHz to 690 MHz. FIG. 10 illustrates antenna performance at horizontal polarization over a TV frequency band from 470 MHz to 690 MHz. The solid line represents measured antenna gain for the antenna feed with the connector of a uniform transmission line of 7 mm in width. The dashed line represents measured antenna gain of the antenna feed with a modified connector of a transmission line having a thin (1 mm in width) conductive trace portion located inside the laminated glass and a wide (7 mm in width) portion located outside the laminated glass. The measured antenna gain shows the modified antenna connector improves antenna gain in the TV frequency band from 470 MHz to 690 MHz.

Figure 11:
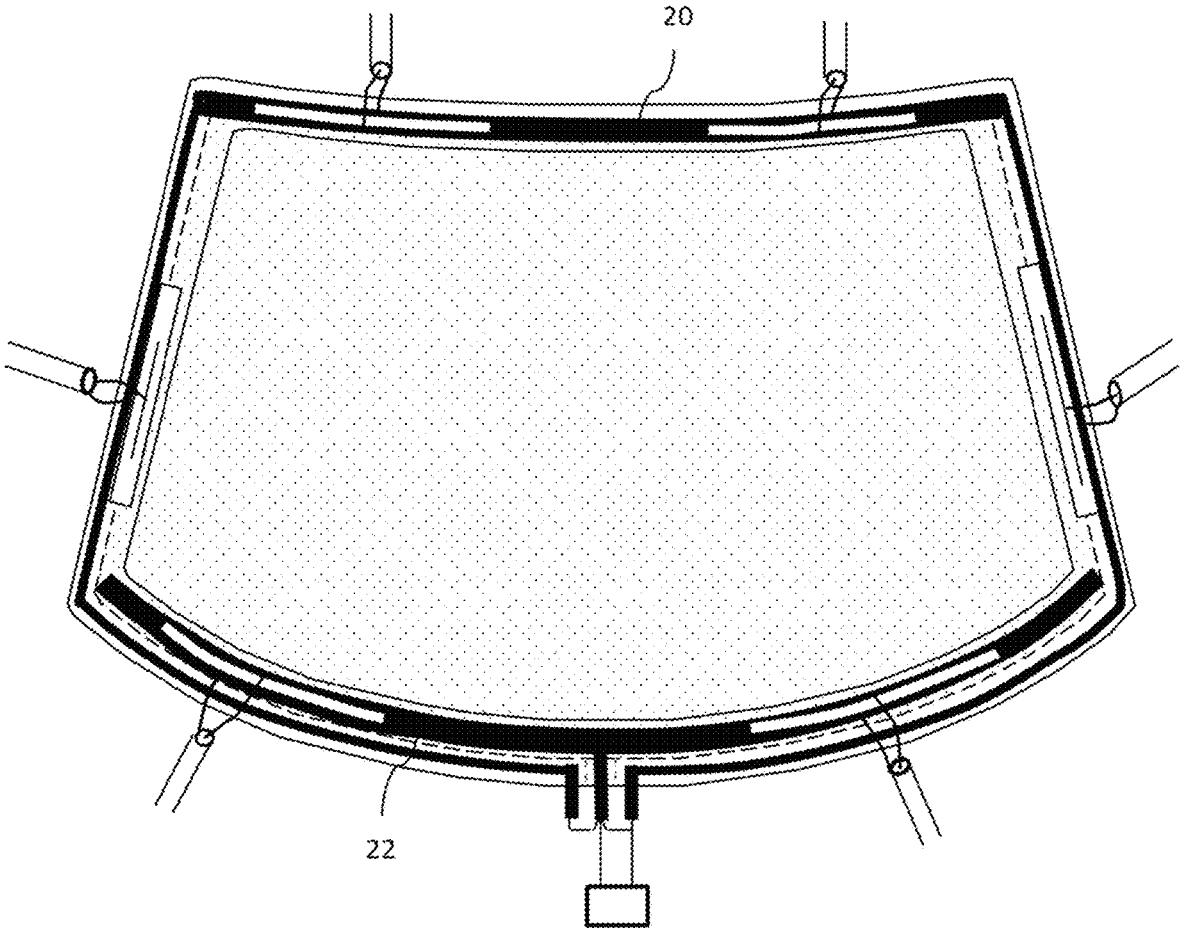
FIG. 11 is a diagram of another embodiment incorporating features of the presently disclosed glazing in which six slot antennas are integrated in the windshield.

The embodiment of FIG. 11 represents a further development in accordance with the presently disclosed invention. In the embodiment of FIG. 11, a portion of top bus bar 20 and bottom bus bar 22 are separated into separate lengths or segments that define a split or slot opening to generate a plurality of slot antennas. Each length or segment corresponds to a respective slot antenna. FIG. 11 illustrates six separate slot antennas with two slot antennas on top bus bar 20, two slot antennas on bottom bus bar 22 and a slot antenna on each side of the glazing—all of which are incorporated in the windshield. Each antenna is fed independently by a voltage source or a coupled coplanar line. The top two antennas are symmetrically located along the top side of the windshield. The two antenna feeds are at least $\lambda/4$ wavelength apart so they are weakly coupled, i.e. both can be used simultaneously for VHF and UHF diversity antenna system. The same is true for the bottom two antennas which also can be used for diversity antenna application. The antenna also can be fed at both sides of the window transparency resulting in still further spatial and pattern diversity.

While the invention has been described and illustrated by reference to certain preferred embodiments and implementations, those skilled in the art will understand that various modifications may be adopted without departing from the spirit of the invention or the scope of the following claims.

What is claimed is:

1. A glazing that is electrically heatable and that is receivable in a frame such that, at times when said glazing is received in said frame, said glazing cooperates with said frame to define an antenna, said glazing comprising:

a transparency sheet having a major surface that is defined within a perimeter edge;

an electrically conductive coating that is located on the major surface of said transparency sheet;

a first bus bar, said first bus bar having electrical conductivity that is greater than the electrical conductivity of said electrically conductive coating, said first bus bar contacting said electrically conductive coating adjacent a first portion of the perimeter edge of said transparency sheet;

a second bus bar, said second bus bar having electrical conductivity that is greater than the electrical conductivity of said electrically conductive coating, said second bus bar contacting said electrically conductive coating adjacent a second portion of the perimeter edge of said transparency sheet, with said second portion of the perimeter edge of said transparency sheet being located oppositely on said transparency sheet from said first portion of the perimeter edge of said transparency sheet;

a first electrically-conductive member that is electrically isolated from direct current in said second bus bar and from direct current in said electrically conductive coating, said first electrically-conductive member having a first portion that is located between said first bus bar and said second portion of the perimeter edge of said transparency sheet, said first electrically conductive member also having a second portion that is located adjacent said second portion of the perimeter edge of said transparency sheet;

a second electrically-conductive member that is electrically isolated from direct current in said second bus bar and from direct current in said electrically conductive coating, said second electrically-conductive member having a first portion that is located between said first bus bar and said second portion of the perimeter edge of said transparency sheet, said second electrically conductive member also having a second portion that is located adjacent said second portion of the perimeter edge of said transparency sheet;

a slot in said electrically-conductive coating, said slot having oppositely disposed sides with one side of said slot defined by one of said first and second electrically-conductive members, said slot having a second side that is oppositely disposed from said one side of said slot, said second side of said slot being defined by a portion of an edge of said electrically-conductive coating, said slot having a length and width such that said slot cooperates with said one of said first and second electrically-conductive members, with said frame, and with said electrically-conductive coating to define a slot antenna; and an antenna feed connector that is electrically connected to said first and second bus bars, said antenna feed connector extending outside said second portion of the perimeter edge of said transparency sheet.

2. The glazing of claim 1 wherein said first and second bus bars and said first and second electrically-conductive members are bonded to said transparency sheet at locations adjacent the perimeter edge of said transparency sheet, said first and second bus bars and said first and second electrically-conductive members overlapping said frame such that said slot antenna is capacitively coupled to said frame at RF frequencies, and wherein said electrically-conductive coating, said first and second bus bars, and said first and second electrically-conductive members cooperate with said frame to define a ground plane at RF frequencies.

3. The glazing of claim 2 wherein a first slot line in said electrically-conductive coating isolates said first and second electrically-conductive members from direct current flowing in said electrically-conductive coating and from direct current flowing in said second bus bar.

4. The glazing of claim 3 wherein said electrically-conductive coating is electrically connected at RF frequencies to the first and second electrically-conductive members through capacitive coupling across said first slot line in said electrically-conductive coating.

5. The glazing of claim 4 wherein a portion of said electrically-conductive coating is removed adjacent a first edge of at least one of said first and second electrically-conductive member to define said slot antenna, at least one of said first and second electrically-conductive members having a first edge that faces said edge of said electrically-conductive coating such that a portion of said first edge of at least one of said first and second electrically-conductive members defines one side of said slot antenna and a portion of the perimeter edge of said electrically-conductive coating defines the opposite side of said slot antenna.

6. The glazing of claim 5 wherein said slot antenna is fed by a coaxial cable with the outer conductor of said coaxial cable electrically connected to said frame also to said first or second electrically-conductive member through capacitive coupling, and wherein the center conductor of said coaxial cable is connected to an antenna feed pad that is located on the perimeter edge of said electrically-conductive coating.

7. The glazing of claim 5 wherein said slot antenna is fed by a coaxial cable with the outer conductor of said coaxial cable electrically connected to said frame and also connected to said first or second electrically-conductive member through capacitive coupling, and wherein the center conductor of said coaxial cable is connected to a first antenna feed pad that is located on the perimeter edge of said electrically-conductive coating, said center conductor also being connected to a second antenna feed pad that is located on the perimeter edge of said electrically-conductive coating.

8. The glazing of claim 7 wherein said first slot line electrically isolates said first antenna feed pad or said second antenna feed pad from direct current in said electrically-conductive coating, and wherein said first antenna feed pad or said second antenna feed pad are electrically connected to said electrically-conductive coating at RF frequencies through capacitive coupling.

9. The glazing of claim 5 further comprising a second slot line in said electrically-conductive coating, said second slot line defining a first end at a first location where said second slot line intersects said portion of the perimeter edge of said electrically-conductive coating that defines the opposite side of said slot antenna, said second slot line further defining a second end at a second location where said second slot line intersects said portion of the perimeter edge of said electrically-conductive coating that defines the opposite side of said slot antenna, with said either said first antenna feed pad or said second antenna feed pad being located on the perimeter edge of said electrically-conductive coating that defines the opposite side of said slot antenna and between the first end and the second end of said second slot line such that said second slot line mitigates cold spots on said electrically-conductive coating between said first antenna feed pad and said second antenna feed pad and also mitigates hot spots on said electrically-conductive coating adjacent said first antenna feed pad and adjacent said second antenna feed pad.

10. The glazing of claim 5 wherein said first antenna feed pad and said second antenna feed pad are located on the perimeter edge of said electrically-conductive coating that defines the opposite side of said slot antenna, said glazing further comprising a second slot line in said electrically-conductive coating, said second slot line defining a first end at a location where said second slot line intersects said portion of the perimeter edge of said electrically-conductive coating that defines the opposite side of said slot antenna wherein said first end of said second slot line is also located outside the side of the slot antenna that is between said first antenna feed pad and said second antenna feed pad, said second slot line further defining a second end that terminates in said electrically conductive coating at a location that is equidistant from said first antenna feed pad and said second antenna feed pad, such that said second slot line defines an "L-shaped" pattern between said first end and said second end.

11. The glazing of claim 10 wherein said "L-shaped" second slot line biases direct current flowing in said electrically-conductive coating around said second slot line such that the voltage potential at said first antenna feed pad tends to be equivalent to the voltage potential at said second antenna feed pad.

12. The glazing of claim 5 wherein said slot antenna is fed by a coupled coplanar line that is laterally spaced between the edge of said first electrically conductive member and the perimeter edge of said electrically-conductive coating that defines the opposite side of said slot antenna, or wherein said coupled coplanar line is laterally spaced between the edge of said second electrically-conductive member and the perimeter edge of said electrically-conductive coating that defines the opposite side of said slot antenna.

13. The glazing of claim 5 wherein the outer conductor of said coaxial cable is connected to said first electrically-conductive member or to said second electrically-conductive member, and the center conductor of said coaxial cable is extended and coiled in the antenna slot and connected back to said first or said second electrically-conductive member to form loops in the center conductor that excite the slot antenna by magnetic coupling.

14. The glazing of claim 2 wherein said first slot line has a width in the range of 0.05 mm to 0.2 mm, preferably in the range of 0.08 mm to 0.1 mm.

15. The glazing of claim 1 wherein said antenna feed connector further comprises:

a first conductive trace portion that is located inside the glazing laminate, said first conductive trace portion having one end that is connected to at least one of said first antenna feed pad and said second antenna feed pad; and a second conductive trace portion that is located outside the glazing laminate, said second conductive trace portion being electrically connected to said first conductive trace portion and having a cross-section area that is larger than the cross-section area of said first conductive trace portion.

16. The glazing of claim 15 wherein said first conductive trace portion reduces capacitive coupling between said antenna feed connector and said first and second electrically-conductive members to improve impedance matching of said slot antenna.

17. The glazing of claim 15 wherein said second conductive trace portion increases capacitive coupling between said antenna feed connector and said frame to improve impedance matching of said slot antenna.

18. The glazing of claim 1 wherein at least one of said first electrically-conductive member and said second electrically-conductive member defines two branches with a split between said two branches such that said two branches cooperate to form a slot antenna between said two branches.

19. The glazing of claim 18 wherein the branches of said first electrically-conductive member or the branches of said second electrically-conductive member have higher electrical conductivity than said electrically-conductive coating.

20. The glazing of claim 19 wherein the electrical current of said slot antenna concentrates in said two branches.

21. The glazing of claim 20 wherein said branches improve the efficiency of said slot antenna by reducing resistive losses caused by electrical current.

22. The glazing of claim 1 wherein at least one of said first bus bar or said second bus bar is split into two sub-buses such that said two sub-buses define a slot antenna between said split sub-buses.

23. The glazing of claim 22 wherein a multiple of said split sub-buses are located at respective positions in said glazing to form respective multiple slot antennas with said split sub-buses being located at least $\lambda/4$ wavelength apart from each other as measured according to wavelengths at operational frequencies of said slot antenna to provide an antenna diversity system.

24. The glazing of claim 23 wherein said slot antennas of split sub-buses are used for UHF antennas that include DAB and TV frequencies.

25. The glazing of claim 24 wherein said antenna slot is laterally located apart from the perimeter edge of said transparency sheet such that adhesives that bind the transparency sheet to said frame do not affect the performance of said slot antenna.

26. The glazing of claim 25 wherein said slot antenna enables control of tolerances during commercial production.

* * * * *